US005259146A

United States Patent [19]

Jinkins

[11] Patent Number: 5,259,146

[45] Date of Patent: Nov. 9, 1993

[54] DEVICE AND METHOD FOR SHAPING THE END OF A ROD

[76] Inventor: Perry L. Jinkins, 210 Arrow St., Freeport, Tex. 77541

[21] Appl. No.: 928,005

[22] Filed: Aug. 11, 1992

[51] Int. Cl.[5] ..... B24B 5/18

[52] U.S. Cl. ..... 51/237 R; 51/289 R

[58] Field of Search ..... 51/236, 237 R, 216 R, 51/216 P, 217 R, 217 P, 218 P, 109 R, 129, 289 R; 269/287, 3

[56] References Cited

U.S. PATENT DOCUMENTS

| | | | |
|---|---|---|---|
| 121,940 | 12/1871 | Harris | 51/237 R |
| 3,125,836 | 3/1964 | Printz | 51/229 |
| 4,575,971 | 3/1986 | Keneson | 51/236 |
| 4,676,028 | 6/1987 | Kaczmarski et al. | 51/237 R |
| 5,001,868 | 3/1991 | Jankus et al. | 51/237 R |
| 5,184,432 | 2/1993 | Wilson | 51/217 T |

FOREIGN PATENT DOCUMENTS

| | | | |
|---|---|---|---|
| 3446762 | 6/1986 | Fed. Rep. of Germany | 51/170 T |
| 0146752 | 7/1920 | United Kingdom | 51/237 R |

*Primary Examiner*—Robert A. Rose

[57] ABSTRACT

A device and method for shaping an end of an elongated workpiece is disclosed. The device comprises an elongated tubular handle containing a coaxially positioned elongated tubular member which is journaled for rotation within the handle. The tubular member protrudes from both ends of the handle and has a clamping means for securing an inserted workpiece therein on one end thereof and a retaining means on the other end which prevents the tubular member from sliding out of the handle unless the retaining means is removed. In operating the device, a workpiece is inserted into the tubular member to the desired length, clamped into that position, then is applied by the operator of the device to a revolving shaping tool, such as a grinder, whereupon the workpiece is caused to rotate by its contact with the revolving tool until the desired shape is achieved.

21 Claims, 4 Drawing Sheets

DEVICE AND METHOD FOR SHAPING THE END OF A ROD

FIELD OF THE INVENTION

Device for holding an elongated workpiece, esp. a metal electrode, against a revolving shaper for shaping the end of the workpiece.

BACKGROUND OF THE INVENTION

There are occasions when there is a need to shape the end of an elongated workpiece by holding it against a revolving shaper. For instance, practitioners of electric arc welding are aware of the problems encountered when the point of a non-consumable metal electrode (such as tungsten or carbon) becomes eroded by the intense heat of the spark which occurs when electricity is caused to deliberately form an arc from the pointed end of the electrode rod to the site where welding is performed. The ionizing action of the electric arc produces very high temperatures at the tip of the electrode and causes erosion of the point. Practitioners find that they need to re-sharpen the rod frequently in order to cause the spark to be uniform and avoid stray sparks. When working in the field, away from a well-equipped and well-supplied shop area, the practitioners find it difficult to re-sharpen the end of a worn electrode and still maintain an efficient rate of welding. It has been customary for the welder to find a way to hold the welding rod against a grinder while trying to maintain a constant angle and pressure of the rod against the revolving grinder so as to form a uniformly shaped point aligned exactly with the axis of the rod. The usual field practice has been to hold the rod with a welding glove or other heat resistant item while trying to manually revolve the rod itself in order to get the proper shape; this is a time consuming procedure due to the difficulty of quickly obtaining a good point. Furthermore, the grinding causes the rod to get very hot, requiring that it be often cooled by immersing it in water or some other cooling liquid before continuing the grinding. Also, there is a tendency of the electrode to be pulled out of the welder's glove by the considerable friction caused by the grinding activity. Difficulty in grinding by hand often causes not only loss of time, but also waste of the expensive tungsten metal of which the rod is comprised.

A device which has been suggested (U.S. Pat. No. 4,575,971) in recent years is the use of a relatively thick metal round bar having a hole completely bored through its center from end to end; the hole is only slightly larger in diameter than the electrode and the electrode is intended to spin in the bore when in contact with a grinder. A number of holes are drilled into the round bar at preselected locations in a row along the bar, normal to, and communicating with, the axial bore. A screw with a blunt rounded nib on its end is placed in the hole selected by the operator of the device and an electrode is slid into the bore as far as permitted by the nib of the screw. The inserted welding rod, when held against a grinder will revolve within the bore by the grinding activity, but the same activity which causes the welding rod to revolve against the grinder also tends to pull the rod out of the bore. The nib on the end of the screw serves to limit the extent to which the rod is inserted in the bore, but does not hold the revolving welding rod from being pulled out of the bore by the revolving action of the grinder. Furthermore, the use of a nib to block the inserted end of the electrode which is in the bore could cause undue wear on the revolving electrode if that inserted end had been sharpened to a fine point.

It is an object of this invention to provide a device for holding an elongated workpiece against a revolving shaper whereby the device permits the elongated workpiece itself to be revolved by the action of the revolving shaper, but does not permit the revolving shaper to pull the elongated workpiece from its holding device.

It is also an object of this invention to provide a method for creating an essentially symmetrical shape on an end of an elongated workpiece whereby the elongated workpiece is removably fastened within a device which is easily held by hand some other cooling liquid before continuing the grinding. Also, there is a tendency of the electrode to be pulled out of the welder's glove by the considerable friction caused by the grinding activity. Difficulty in grinding by hand often causes not only loss of time, but also waste of the expensive tungsten metal of which the rod is comprised.

A device which has been suggested (U.S. Pat. No. 4,575,971) in recent years is the use of a relatively thick metal round bar having a hole completely bored through its center from end to end; the hole is only slightly larger in diameter than the electrode and the electrode is intended to spin in the bore when in contact with a grinder. A number of holes are drilled into the round bar at preselected locations in a row along the bar, normal to, and communicating with, the axial bore. A screw with a blunt rounded nib on its end is placed in the hole selected by the operator of the device and an electrode is slid into the bore as far as permitted by the nib of the screw. The inserted welding rod, when held against a grinder will revolve within the bore by the grinding activity, but the same activity which causes the welding rod to revolve against the grinder also tends to pull the rod out of the bore. The nib on the end of the screw serves to limit the extent to which the rod is inserted in the bore, but does not hold the revolving welding rod from being pulled out of the bore by the revolving action of the grinder. Furthermore, the use of a nib to block the inserted end of the electrode which is in the bore could cause undue wear on the revolving electrode if that inserted end had been sharpened to a fine point.

It is an object of this invention to provide a device for holding an elongated workpiece against a revolving shaper whereby the device permits the elongated workpiece itself to be revolved by the action of the revolving shaper, but does not permit the revolving shaper to pull the elongated workpiece from its holding device.

It is also an object of this invention to provide a method for creating an essentially symmetrical shape on an end of an elongated workpiece whereby the elongated workpiece is removably fastened within a device which is easily held by hand and which allows the elongated workpiece to become shaped by a revolving shaper as the workpiece is itself revolved, but is not permitted to be pulled from the device by the revolving action.

Yet another object is to provide a device which can be used to shape both ends of a workpiece, since the present device permits a shaped end to be inserted into the device without it becoming damaged when the other end of the workpiece is positioned in the device for shaping on a revolving shaper.

Still another object is to provide an essentially lathe-quality shaping of the end of a workpiece by employing the present device.

While the present descriptions and teachings are directly mainly to shaping of metal workpieces, especially welding rods, it will become apparent to others, upon reading the present disclosure, that the present device can be used for other elongated workpieces. Also, the revolving shaper may be a cutting, grooving or smoothing device as well as a grinder referred to in this disclosure.

SUMMARY OF THE INVENTION

The device of the present invention comprises an elongated hollow handle member having a first end and a distal end and containing an axially aligned revolvable tubular member journaled for rotation within said handle member, and protruding therefrom at both ends, said tubular member having on its first end a clamping means for securing an elongated workpiece inserted therein to a predetermined distance, and having a securing means at the distal end for preventing the tubular member from sliding in the direction of the first end.

The method of the present invention comprises the method of shaping an end of an elongated workpiece, using a device as described above, by inserting a predetermined portion of the workpiece into the tubular member which is journaled for rotation within the elongated handle member, clamping the elongated workpiece in the assembly with a portion of it protruding therefrom, and thereafter holding the protruding portion of the workpiece at a predetermined angle against a revolving shaping device, whereupon the workpiece, along with the clamping means and tubular member, is caused to be rotated by the contact with the revolving shaping device, and ceasing the shaping upon achieving the desired shape on the end of the workpiece.

BRIEF DESCRIPTION OF DRAWINGS

FIG. 1, shown in cross-section except for the centrally located pointed rod, helps in describing the device with the handle, tubular member, bearings where the tubular member is journaled, a pointed workpiece within the tubular member, means for positively securing the workpiece at the first end of the device, and means for securing the distal end of the tubular member against sliding in the direction of the first end.

FIG. 1*a*, shown in cross-section, is an enlarged view of the distal end of the tubular member of FIG. 1 to more clearly disclose the threaded portion onto which a nut is screwed.

FIG. 1*b*, shown in cross-section, demonstrates another manner of securing the distal end of the tubular member from sliding out toward the first end of the handle.

FIG. 2, shown in cross-section except for the ferruled grasping portions of the chuck member, demonstrates the device wherein a Starret* chuck (*well-known tradename) is affixed to the first end of the tubular member and more clearly shows a ferrule washer between the chuck mechanism and the end of the first end of the handle. In this view, with the tubular member pulled a short way in the direction of the first end, a securing means for the distal end of the tubular member is not in place.

FIG. 3, shown in cross-section except for the centrally located pointed workpiece, demonstrates a positive clamping device on the first end of the tubular member and a compressed spring means on the distal end between a threaded nut on the end of the tubular member and the handle by which the jaws of the clamping device at the first end of the tubular member are opened (when the spring is compressed) and closed around the pointed workpiece (when the compression of the spring is released). In this embodiment the bearing or brushing turns with the tubular member, journaling against the inside surface of the handle.

FIG. 4, shown in cross section except for the pointed rod, demonstrates a partial view of a device similar to that of FIG. 3 to further show a positive clamping means at the first end of the device formed by making splits in the tubular member to form widened spreadable portions which, when pulled back inside the handle, provide clamping pressure on the pointed workpiece within the tubular member. In this embodiment, the bearing or bushing turns with the tubular member, journaling against the inside surface of the handle.

DETAILED DESCRIPTIONS INCLUDING BEST MODE

Figure 1A:
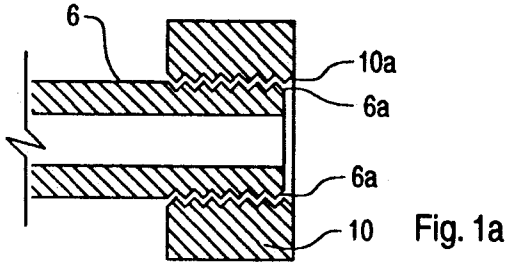
FIGS. 1, 1*a*, 1*b*, 2, 3, and 4, none of which are drawn to any exact scale, are provided as visual aids for relating various embodiments of the present invention device.

The present inventive device comprises an elongated straight hollow member (which serves as a handle when the device is being used in a shaping operation) having a first end and a distal end and having bearing or bushing means on its inside through which an elongated straight tubular member of lesser outside diameter than the inside diameter of the handle, but of greater length than the handle, is concentrically positioned for journaling within the said bearing or bushing means, said tubular member having an inner diameter appropriate for permitting an inserted elongated workpiece to be inserted, said tubular member protruding a predetermined distance from both ends of the handle, with means affixed to the tubular member at the first end for positively securing an elongated workpiece when such workpiece is inserted into the inner tubular, member and means provided on the distal end, removably or not, for securing the inner tubular against sliding out of the handle.

The present invention also comprises a method of shaping an end of an elongated workpiece, said method comprising inserting an elongated workpiece into the above described device with a predetermined amount of it protruding from the device to provide a predetermined angle of contact contact with a shaper, actuating the positive securing means at the first end of the tubular member to prevent the workpiece from axial movement within the tubular member during the shaping operation, positioning the protruding workpiece against the shaper in a predetermined manner to effect the desired shape. After the shaping operation, the workpiece is removed from the tubular member by loosening the positive securing means.

Whereas the present descriptions in this disclosure are directed principally to metal workpieces, especially welding rods, as the workpieces of interest, other workpieces, made of other shapeable materials can be shaped by using devices and methods like the ones particularly described here.

The revolving shapers are usually grinding devices, such as emery wheels, but can be any revolving device which can effect a shape on a workpiece which revolves with the shaper when applied to the shaper.

The tubular member positioned inside is selected to be of a size which will accommodate the workpiece which is to be inserted and later removed. Ordinary new tungsten arc-welding rods are about 7 inches (17.78 cm) long, and they are often worn down to very short pieces of about an inch (2.54 cm) or so during usage. Such welding rods can range in standard increments of 1/16 inch (1.59 mm) diameter to about 3/16 inch (4.77 mm).

Considering that the presently described device can be made of any size which is manageable as a manually-held tool, for workpieces of sizes other than arc-welding rods, then the handle portion need only be of a size which can be grasped and in which a tubular member can be journaled, the tubular member being the portion into which the workpiece is inserted. The tubular member can extend well beyond the distal end of the handle so as to accommodate a workpiece which is considerably longer than the handle. In such cases, the retainer means which keeps the tubular member from sliding toward the first end of the handle during use would not be at the end of the tubular member, but would be located at the distal end of the handle. The present design also permits the making of a device wherein the workpiece can extend beyond the distal end of the tubular device, since it is fastened securely at the first end of the tubular device.

Figure 1:
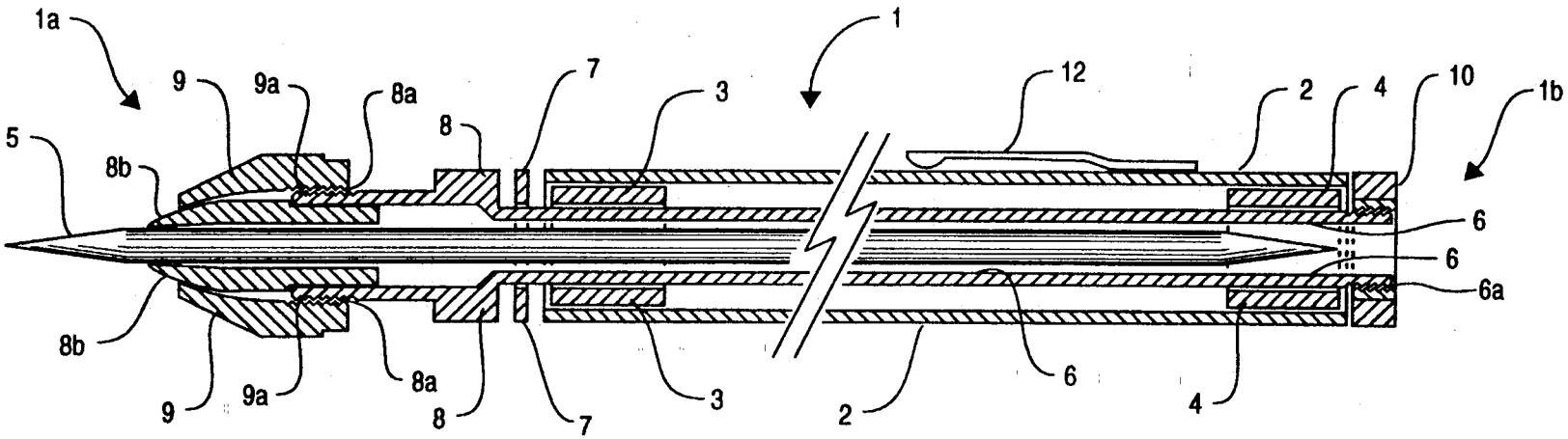

FIG. 1 is provided as a visual aid for relating an embodiment of the device of the present invention. The device is shown in cross-section except for the pointed workpiece 5 centrally positioned therein. The workpiece 5 is only intended as a part of the device while it is being shaped or sharpened on a grinder. The device, denoted generally by the number 1, has a first end, denoted generally as 1*a*, and a distal end, denoted generally as 1*b*. There is a hollow member 2 which will ordinarily function as a handle when in use, having inside of it bearing or bushing means 3 at or near the first end and bearing or bushing means 4 at or near the distal end. Extending through the bearing or bushing means is a tubular member 6 which is of a size which conforms effectively within the bearing or bushing means in providing journaling of tubular member 6 as it spins within handle member 2. At the outer extremity of tubular member 6, at the first end 1*a* of the device, there is a replaceable bushing or ferrule washer 7, which is not absolutely essential, but is recommended so as to extend the useful life of the device by avoiding wear of the portions of the device which are in contact with the bushing or ferrule washer 7. In actual practice, the washer 7 would not need as much space on each side of it as is shown in the not-to-scale figures. As an extension of tube 6 there is shown a chuck portion 8 which is affixed to the first end of tubular member 6 and is of greater diameter than tubular member 6. Threads 8*a* on portion 8 cooperate with threads 9*a* on collar 9 of the chuck when collar 9 is screwed onto portion 8 to close jaws 8*b* around workpiece 5. Portions 8, 8*a*, 8*b*, 9, 9*a*, in effect can represent a chuck substantially like those which are known in the mechanical arts as being a "Starrett chuck". Other means for clamping workpiece 5 in place within tube 6 can be used, such as a collar or ring in cooperation with resilient or spring means against gripping fingers. It should be noted that the inside diameter of tube 6 is large enough to permit the insertion of workpiece 5 therein, but not so large as to allow workpiece 5 to flop around to any significant extent. The distal end 1*b* of tube 6 extends past tube 2 and bearing 4 to an extent at least sufficient for affixing a means for holding tube 6 in position against forces which might tend to cause it to slide through the bearings toward the first end 1*a*. There is depicted a threaded nut 10 in cooperation with threaded portion 6*a* of tube 6 whereby nut 10 prevents tube 6 from sliding out of tube 2 through first end 1*a*. In FIG. 1 there is depicted an optional pocket clip 12 for the convenience of persons who might want to keep the device readily available during their work.

FIG. 1*a* is an enlarged view of the distal end 1*b* of FIG. 1 to more clearly show the threaded nut 10 cooperating at 10*a* with threads 6*a* of tube 6.

Figure 1B:
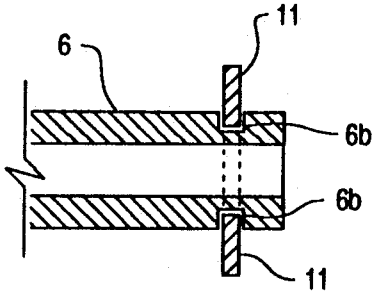

FIG. 1*b* shows an alternate, and in some instances perferred, means of holding tube 6 in place within tube 6 without having to use the threaded nut arrangement as shown in FIG. 1 and FIG. 1*a*. Here there is a slot around the periphery of tube 6, normal to the axis of tube 6. A spring clip 11, or retainer ring or split washer or other such device can be applied in the slot to keep the tube in place.

Figure 2:
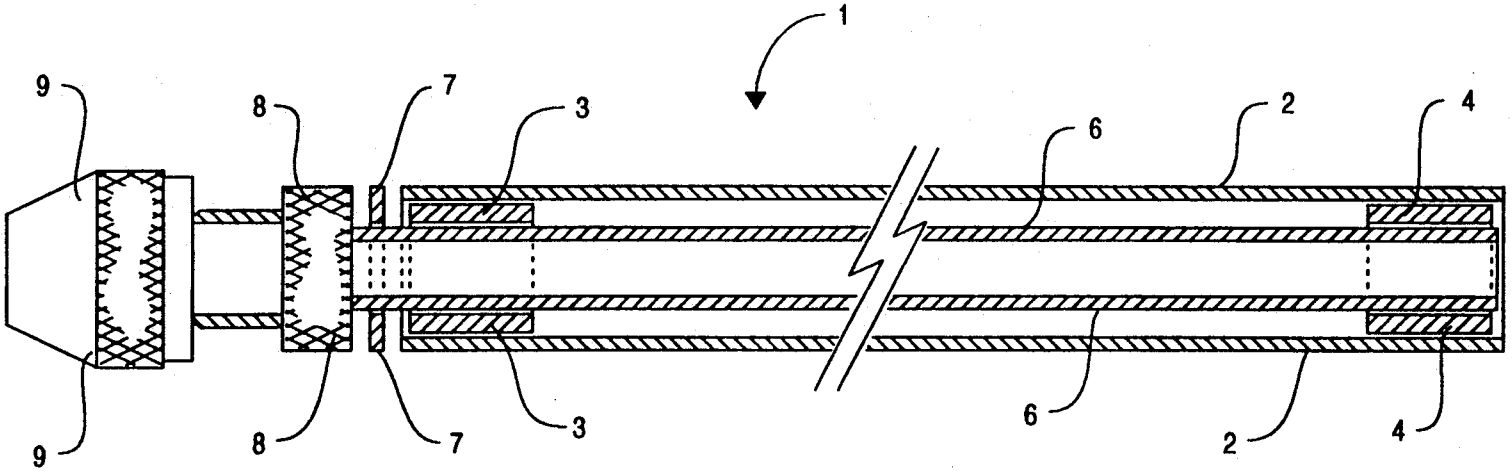

FIG. 2 is a cross-sectional view of a device 1 without the workpiece and without the securing means on the distal end of the tubular member shown in FIG. 1. Here the tubular member 6 is pulled a small amount out of the handle 2 to show attachment of a chuck mechanism 8 (not in cross-section) to the tubular member 6 and also more clearly show a ferrule washer 7 around the tubular member 6, between a portion of the chuck mechanism 8 and the handle 2. The bearing or bushing means 3 and 4 are also shown. At the extreme first end (not in cross-section) is a portion 9 of chuck mechanism which cooperates with portion 8 to manipulate the opening and closing of the jaws of the chuck for securing and loosening of a workpiece when needed. By screwing portion 9 one direction, the jaws (shown in FIG. 1) are closed, and when screwed the other direction, the jaws are loosened.

Figure 3:
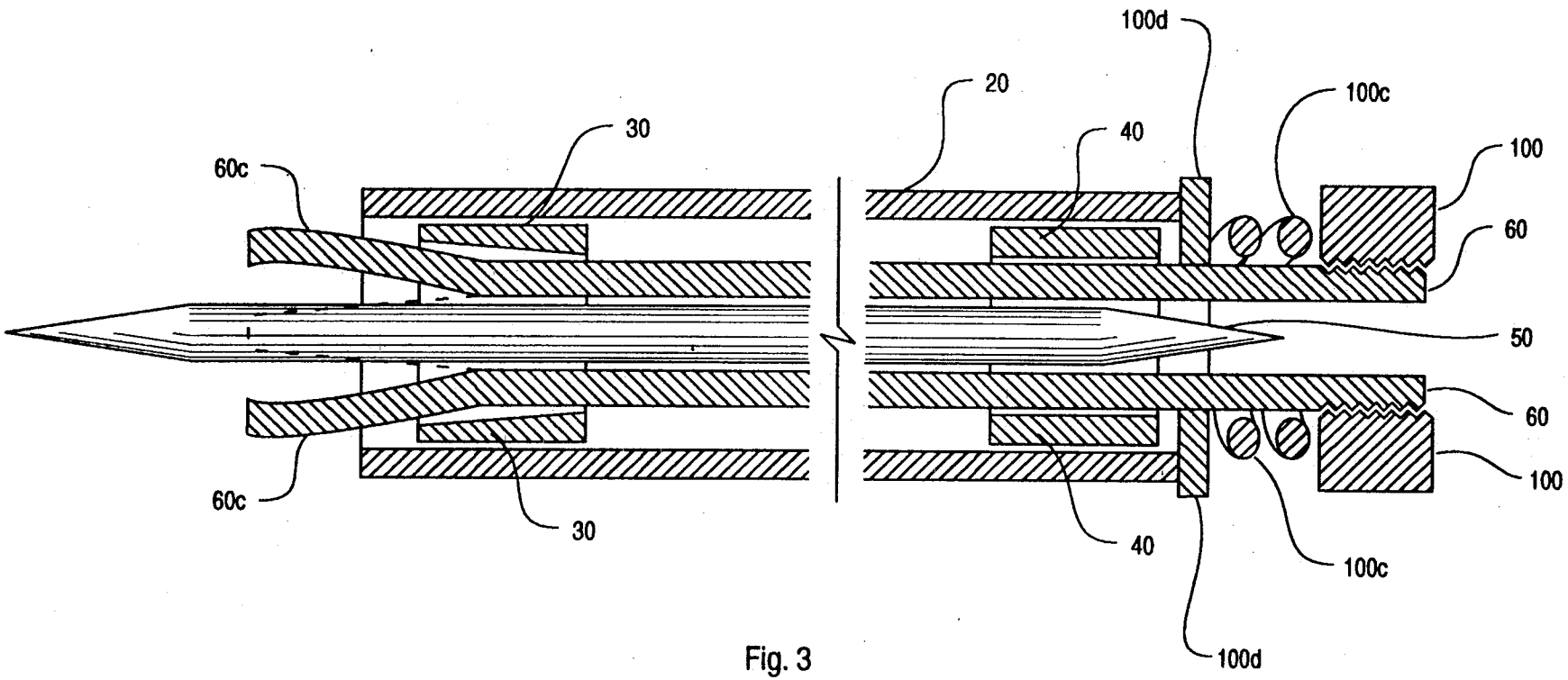

FIG. 3 is a visual aid for relating a clamp mechanism other than a standard chuck. In this embodiment workpiece 50 protrudes from the first end of tubular member 60 which is journaled inside handle 20 with bearings or bushings 30 and 40. In this embodiment tubular member 60 is shown as being split at its first end to form jaws 60*c* and jaws 60*c* are shown as being slightly curved inward toward the workpiece 50. In this view, spring means 100*c* is compressed against an end piece or flange 100*d* at the distal end of handle 20, the compression being achieved by pressure exerted against the distal end of tubular member 60 and nut 100 by forces not shown, but which in practice can be achieved by an operator grasping handle 20 in his fist and exerting force against the distal end with his thumb. Upon releasing the pressure against the distal end, the spring expands pulling jaws 60*c* into bearing 30 which closes the jaws around workpiece 50.

Figure 4:
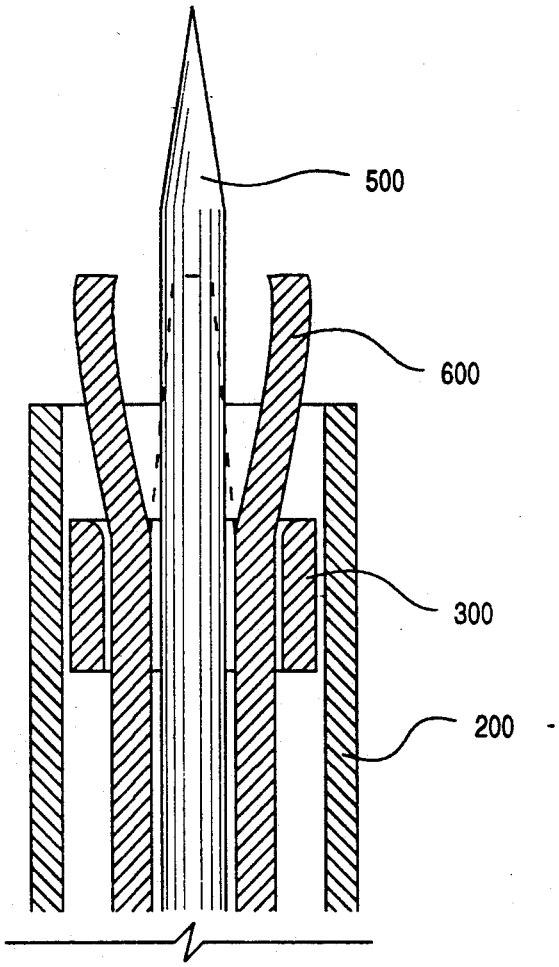

FIG. 4 illustrates a portion of a device of the kind shown in FIG. 3, to show a slightly different shape of the bearing 300 used at the first end of handle 200 and tubular member 600 whereby the jaws of tubular member 600 are closed by being drawn into the bearings by a force which slides tubular member 600 through the bearing 300 toward the distal end of handle 200 until the jaws are tightened around workpiece 500. While not shown, it is within the range and scope of the present invention to employ means other than the compressed spring of FIG. 3 to manipulate the opening and closing of the clamping, such as the use of a threaded nut on the distal end of tubular member with more threads than is shown in FIGS. 1 and 1*a*.

EXAMPLE 1

A device made substantially in accordance with FIG. 1 is prepared using a 5 inch long section of ½ inch I.D stainless steel tube with an oil-impregnated bronze sleeve bearing inside of it near each end. A Starret chuck is welded to an end of a 3/16 inch I.D. stainless steel tube and the tube is inserted through the bearings where it journals effectively with the handle. There is enough length of the inside tube to fasten a threaded nut at the end protruding from the 5 inch long tube as as to prevent the inside tube from coming out in the direction of the chuck. The 5 inch long outer tube functions well as a means for grasping the device. A tungsten welding rod is inserted into the inside tube and held against a revolving emery wheel where a concentric, well-defined point of essentially lathe-quality is formed. During the shaping of the point, the tendency of the rod to be pulled out by the action of the revolving emery wheel is thwarted by the fact that the inside tube, which is also spinning with the rod, cannot be pulled from the handle because of the retainer on the other end.

The present invention is not limited to the particular embodiments and examples shown in this disclosure, and others, having learned of this invention, may incorporate the invention in other embodiments without departing from the range and scope of the inventive concept of which comprises this invention. The invention is limited only by the broadest interpretation accordable to the claims which follow.

What is claimed is:

1. A device for holding an elongated workpiece during a shaping operation of an end of the workpiece to form a concentric point thereon, said device comprising an elongated tubular handle member having a first end and a distal end, a smaller diameter, but longer, inner tubular member concentrically journaled inside said handle member and protruding from both ends thereof, a clamping means affixed to, and rotatable with, the inner tubular member at the first end, and a means for securing the distal end of the inner tubular member at the distal end of the handle member, said clamping means effective for securing in place an elongated workpiece inserted into the inner tubular member a predetermined distance, said inner tubular member being thereby prevented from being pulled out of the handle while the securing means is in place.

2. The device of claim 1 wherein the clamping means is a chuck means.

3. A device for holding an elongated workpiece during a shaping operation of an end of the workpiece, said device comprising an elongated tubular handle member having a first end and a distal end, a smaller diameter, but longer, inner tubular member concentrically journaled inside said handle member and protruding from both ends thereof, a clamping means affixed to, and rotatable with, the inner tubular member at the first end, and a means for securing the distal end of the inner tubular member at the distal end of the handle member, said clamping means effective for clamping in place an elongated workpiece inserted into the inner tubular member a predetermined distance, wherein the means for securing the distal end of the inner tubular member is a retainer ring fitted into a peripheral groove near the distal end of the inner tubular member.

4. A device for holding an elongated workpiece during a shaping operation of an end of the workpiece, said device comprising an elongated tubular handle member having a first end and a distal end, a smaller diameter, but longer, inner tubular member concentrically journaled inside said handle member and protruding from both ends thereof, a clamping means affixed to, and rotatable with, the inner tubular member at the first end, and a means for securing the distal end of the inner tubular member at the distal end of the handle member, said clamping means effective for holding in place an elongated workpiece inserted into the inner tubular member a predetermined distance, wherein the said securing means is a threaded nut applied to threads provided at the distal end of the inner tubular member.

5. The device of claim 1 wherein the journaling of the inner tubular member against the inside surface of the handle member is provided by a means selected from bearing means and bushing means.

6. The device of claim 1 wherein the journaling of the inner tubular member against the inside surface of the handle member is provided by a means selected from needle bearings and roller bearings.

7. The device of claim 1 wherein there is attached to the outer surface of the handle member a clip effective for clipping the device in a pocket or other selected position when not in use.

8. The device of claim 1 wherein a workpiece is positioned in the inner tubular member.

9. The device of claim 1 wherein a welding rod is positioned in the inner tubular member.

10. The device of claim 1 wherein a tungsten rod is position in the inner tubular member.

11. A method of shaping an end of an elongated workpiece using the device of claim 1, said method comprising, inserting a predetermined portion of the workpiece into the tubular member of the device of claim 1, clamping the workpiece in place by using the clamping means provided on the device, leaving a predetermined length of the workpiece protruding from the clamping means, grasping the device by its handle and positioning the end of the protruding workpiece against a revolvable shaper at an angle appropriate to achieve the desired shape, whereby the workpiece and the tubular member revolve inside the handle, and removing the workpiece from the revolvable shaper.

12. A device for holding a welding rod during shaping of an end of the rod against a rotating shaper to form a concentric point thereon, said device comprising an elongated tubular handle member having a first end and a distal end and having, a smaller diameter, but longer, inner tubular member concentrically journaled inside said handle member, protruding from both ends thereof, a clamping means affixed to, and rotatable with, the inner tubular member at the first end, and a means for securing the distal end of the inner tubular member at the distal end of the handle member which prevents the inner tubular member from being pulled out in direction of the first end, said clamping means effective for securing in place an elongated workpiece inserted into the inner tubular member a predetermined distance.

13. The device of claim 12 wherein the clamping means is a chuck, and the securing means on the distal end of the inner tubular member is a thread nut or a retainer ring.

14. The method of shaping an end of an elongated workpiece to form a concentric point thereon, said method comprising, inserting a predetermined portion of the workpiece into a tubular member which is journaled for rotation within an elongated hollow handle, clamping the elongated workpiece in position in the tubular member, with a portion of it protruding therefrom, by using a clamping means affixed on a first end of the tubular member, with the other end of the tubular member being secured at the distal end of the handle with a retaining member which prevents the inner tubular member from being pulled out toward the first end, and thereafter holding the protruding portion of the workpiece at a predetermined angle against a revolving shaping device, whereupon the workpiece and the tubular member are caused to be rotated by contact with the revolving shaping device, and ceasing the shaping upon achieving the desired shape on the end of the workpiece.

15. The method of claim 14 wherein the workpiece is a metal rod.

16. The method of claim 14 wherein the workpiece is a welding rod.

17. The method of claim 14 wherein the workpiece is a tungsten electrode.

18. The method of claim 14 workpiece is a carbon or graphite electrode.

19. The method of claim 14 wherein the clamping means is a chuck.

20. The method of claim 14 wherein the clamping means comprises cooperating jaws positioned on the first end of the tubular member, said jaws being tightenable against the workpiece when compressed upon pulling the first end of the tubular member farther into the handle, thus drawing the jaws into a confining space defined within the handle member in which the tubular member is journaled.

21. A device for holding an elongated workpiece during a shaping operation of an end of the workpiece to form a concentric point thereon, said device comprising an elongated tubular handle member having a first end and a distal end, a smaller diameter, but longer, inner tubular member concentrically journaled inside said handle member and protruding from both ends thereof, a clamping means affixed to, and rotatable with, the inner tubular member at the first end, and a means for securing the distal end of the inner tubular member at the distal end of the handle member, said clamping means effective for securing in place an elongated workpiece inserted into the inner tubular member a predetermined distance, wherein said clamping means comprises an axially compressible resilient means positioned between the distal end of said handle member and the securing means at the distal end of the inner tubular means, which is actuated upon compression to cooperate with retractable resilient clamping jaws on the first end of the inner tubular member to provide opened jaws when the compressible resilient means is compressed and tightened jaws when not compressed.

* * * * *

UNITED STATES PATENT AND TRADEMARK OFFICE

CERTIFICATE OF CORRECTION

PATENT NO. : 5,259,146

DATED : November 9, 1992

INVENTOR(S) : Perry L. Jinkins

It is certified that error appears in the above-identified patent and that said Letters Patent is hereby corrected as shown below:

In column 2, beginning on line 14 with the word "some" and ending in column 2 on line 58 with the work "hand" there is a duplication of the descriptions beginning in column 1, line 40 with the word "some" and ending in columne 2, line 14 with the word "hand".

In column 4, line 43, "tubular, member" should read --tubular member,--.

Signed and Sealed this

Nineteenth Day of April, 1994

Bruce Lehman

*Attest:*

BRUCE LEHMAN

*Attesting Officer*

*Commissioner of Patents and Trademarks*